United States Patent [19]

Powell

[11] Patent Number: 5,020,854

[45] Date of Patent: Jun. 4, 1991

[54] FOLDING CHAIR CONSTRUCTED OF SHEET MATERIAL

[76] Inventor: Robert A. Powell, 146 - 46th St., Sacramento, Calif. 95819

[21] Appl. No.: 586,145

[22] Filed: Sep. 21, 1990

[51] Int. Cl.[5] ..... A47C 1/14; A47C 7/16

[52] U.S. Cl. ..... 297/377; 5/419; 297/457

[58] Field of Search ..... 297/377, 382, 439, 454, 297/457; 5/417–420, 432–434

[56] References Cited

U.S. PATENT DOCUMENTS

| | | | |
|---|---|---|---|
| 1,659,093 | 2/1928 | Gaskin | 297/377 |
| 2,390,660 | 12/1945 | Muenzen | 297/377 X |
| 4,654,907 | 4/1987 | Haugaard | 5/420 |
| 4,869,553 | 9/1989 | Powell | 297/377 |
| 4,926,512 | 5/1990 | Coyle | 297/377 X |

*Primary Examiner*—Peter R. Brown

*Attorney, Agent, or Firm*—Thomas R. Lampe

[57] ABSTRACT

A folding chair formed from sheet material including a seat panel, a back panel, a support panel, an end panel, and brace panels connected to the support panel and extending between the back panel and end panel.

11 Claims, 2 Drawing Sheets

FOLDING CHAIR CONSTRUCTED OF SHEET MATERIAL

TECHNICAL FIELD

This invention relates to a folding chair formed from sheet material such as corrugated paperboard. More particularly, the chair incorporates structure which contributes to the strength and stability thereof.

BACKGROUND ART

U.S. Pat. No. 4,869,553, issued Sept. 26, 1989 to Robert A. Powell, is directed to a chair of simple, inexpensive construction formed from sheet material which the user may readily and quickly set up for use. Collapse or disassembly of the chair may also be carried out expeditiously. The chair particularly lends itself to use at the beach or other environments where soft ground of floor conditions exist.

Co-pending U.S. Pat. Application Ser. No. 07/564,575, Robert A. Powell, filed Aug. 9, 1990, also relates to a folding chair formed from sheet material and incorporates structure for preventing movement of the chair support panel lower end away from the back panel lower end to retain the support panel and the back panel of the chair at at least one predetermined relative angle.

DISCLOSURE OF INVENTION

The folding chair of the present invention is similar in some respects to the folding chairs covered by the aforesaid patent and co-pending application. However, the folding chair of the present invention incorporates a novel structural arrangement for imparting strength and stability to the chair, particularly to the back panel and support panel components thereof.

The folding chair of the present invention is formed from sheet material and includes a seat panel having an outer surface and spaced first and second ends. The seat panel is adapted to be positioned on the ground.

A back panel having an upper end and a lower end is foldably connected at said lower end to the seat panel second end. The back panel has an outer surface and is adapted to be positioned relative to the seat panel whereby the back panel extends upwardly from the seat panel and the back panel outer surface and the seat panel outer surface define an obtuse angle.

The chair also includes a support panel having an upper end and a lower end. The support panel upper end is located at the back panel and the support panel slants downwardly and away from the back panel toward the ground.

An end panel adapted for positioning on the ground is foldably connected to the support panel at the support panel lower end. The end panel projects from the support panel when positioned on the ground.

At least one brace panel having an upper end and a lower end is connected to the support panel and extends between the back panel and the end panel to strengthen and stabilize the chair.

In the embodiment disclosed herein, a pair of brace panels are connected to the support panel. The brace panels are spaced from one another and foldably connected to opposed side edges of the support panel. The brace panels are folded relative to the support panel, extend inwardly toward the back panel, and are maintained in such position by maintaining means.

Other features, advantages, and objects of the present invention will become apparent with reference to the following detailed description and accompanying drawings.

BEST MODE FOR CARRYING OUT THE INVENTION

Figure 1:
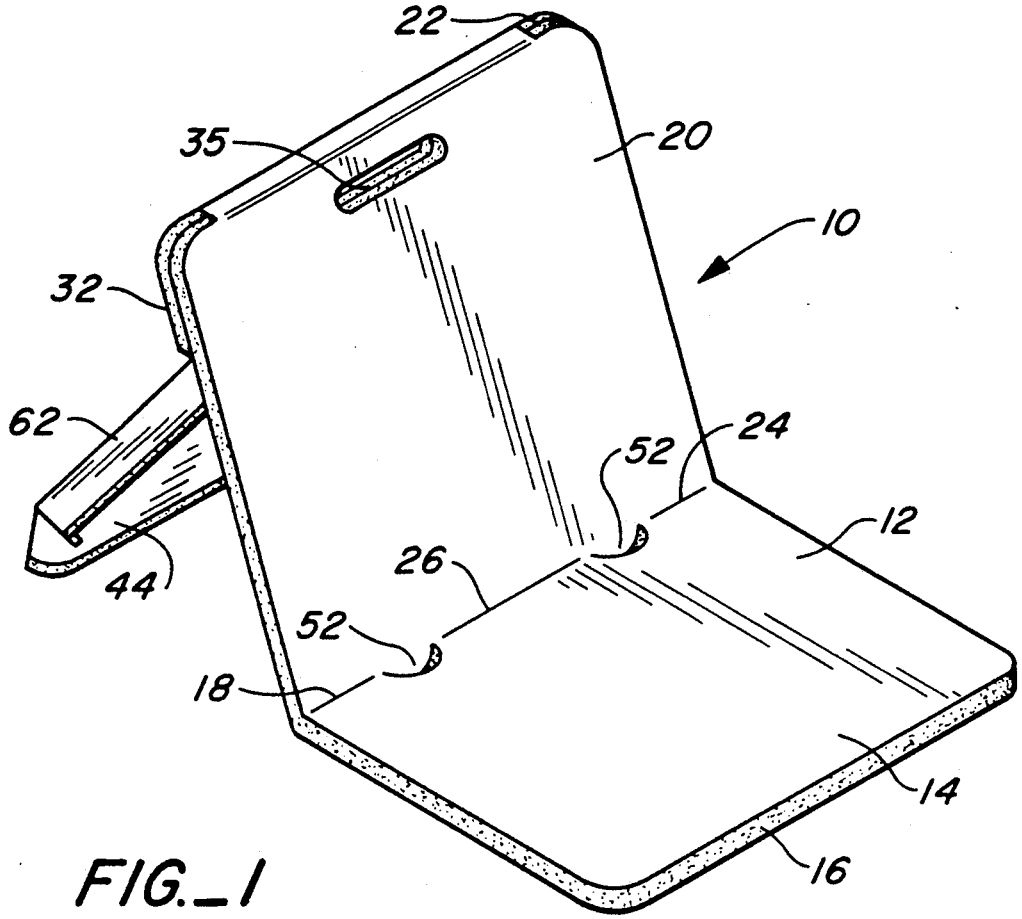
FIG. 1 is a frontal perspective view of a chair constructed in accordance with the teachings of the present invention.

Referring now to the drawings, a folding chair constructed in accordance with the teachings of the present invention is illustrated and generally designated by reference numeral 10. The chair may be constructed of any suitable sheet material such as corrugated paperboard material. When corrugated paperboard material is used, it is preferred that the corrugation flutes be oriented along the major axis of the blank forming the chair.

Chair 10 includes a seat panel 12 having an outer surface 14 and spaced first and second ends 16, 18, respectively. The seat panel 12 is adapted to be positioned on the ground with outer surface 14 facing upwardly. The term "ground" as used herein is employed in its broadest sense to mean any suitable support surface which may, for example, include carpeting and the like.

A back panel 20 having an upper end 22 and a lower end 24 is connected at the lower end to the seat panel second end 18 along a fold line 26. The back panel 20 has an outer surface 28. When the chair 10 is to be utilized, the back panel extends upwardly from the seat panel and the back panel outer surface 28 and the seat panel outer surface 14 define an obtuse angle.

A reinforcement panel 32 is connected to the back panel 20 by any suitable expedient, such as by being glued thereto. In the arrangement illustrated, the reinforcement panel 32 is integral with the back panel and doubled over with respect thereto about a fold 33. A hand hole 35 is defined by the back panel and the reinforcement panel. The reinforcement panel 32 is in registry with a portion of the back panel located between the back panel upper and lower ends and in engagement therewith to reinforce the back panel portion.

A support panel 34 having an upper end 36 and a lower end 38 is attached to the reinforcement panel 32 at a location below the back panel upper end 22. The support panel 34 is connected to the reinforcement panel 32 along a fold line 40.

An end panel 44 adapted for positioning on the ground is foldably connected to the support panel at the support panel lower end 38 along a fold line 46. When the chair 10 is in use, the end panel 44 projects inwardly from the support panel lower end. Fold line 46 intersects semi-circular die cuts defining projections 50 extending downwardly from the support panel. Projections 50 dig into the ground to resist movement of the support panel lower end away from the back panel lower end. The back panel has similar projections 52 accomplishing the same function.

Chair 10 includes a pair of brace panels 60, 62. The brace panels are spaced from one another and foldably connected to the opposed side edges of the support panel. Brace panel 60 is connected to the support panel at fold line 64 and brace panel 62 is connected to the support panel along fold line 66. When the chair is assembled, the brace panels 60, 62 are folded relative to the support panel about fold lines 64, 66 and extend inwardly toward the back panel.

Figure 2:
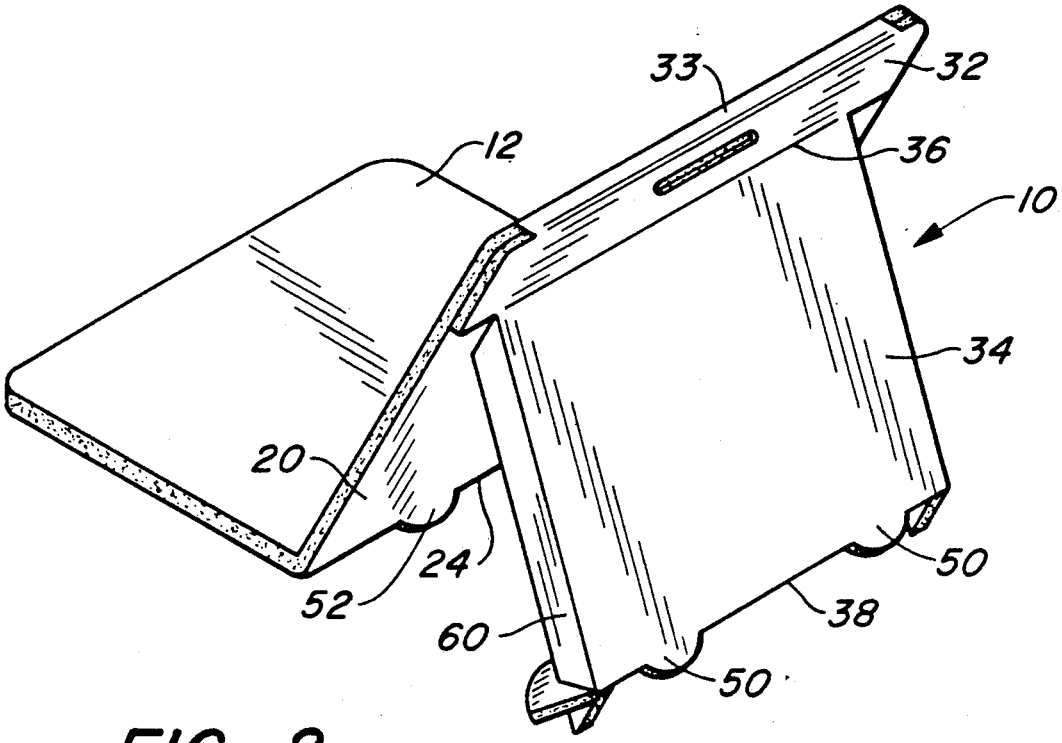
FIG. 2 is a rear perspective view of the chair.
Figure 3:
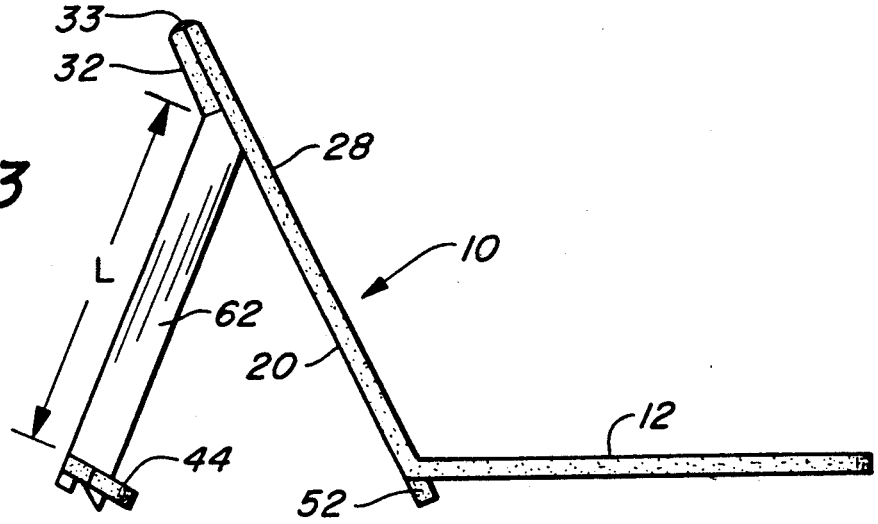
FIG. 3 is a side view of the chair.
Figure 4:
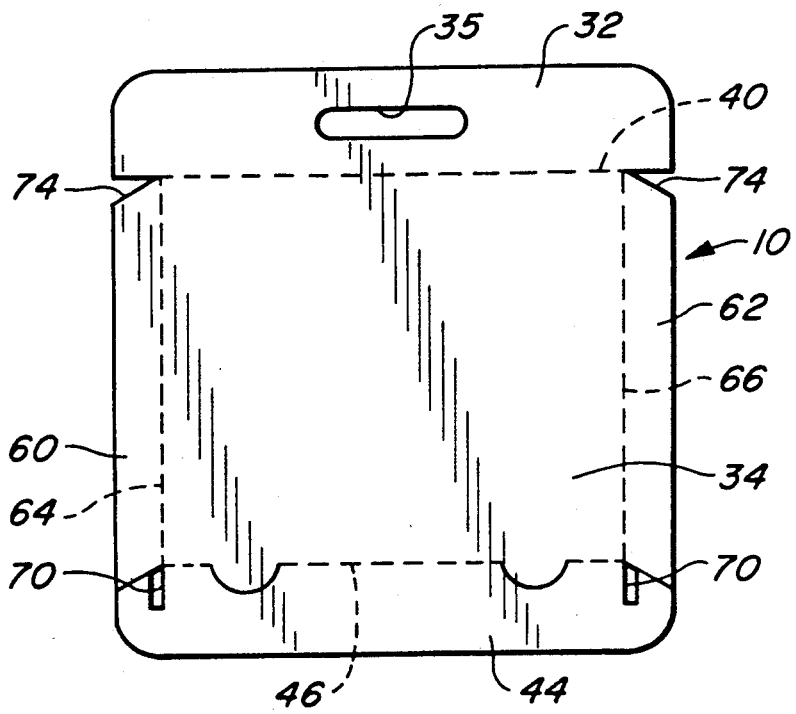
FIG. 4 is a plan view of the chair when in a folded or collapsed condition.

Means is provided for maintaining the brace panels folded relative to the support panel. More specifically, the end panel has slots 70 formed therein which receive the lower ends of the brace panels when the end panel is in the position shown in FIGS. 1–3. It should be noted that the lower ends of the brace panels are tapered to define pointed elements which extend downwardly from the end panel for engagement with the ground. These pointed ground engaging elements assist in maintaining proper positioning of the lower end of the support panel.

The upper ends of the brace panels 60, 62 are tapered to define tapered contact surfaces 74. The angle of the taper is such that the tapered contact surfaces 74 bear against the back panel, contacting the back panel along substantially the full length of the tapered contact surfaces. The brace panel upper ends engage the back panel immediately adjacent to the reinforcement panel.

It will be appreciated that the brace panels 60, 62 impart structural strength and stability to the assembled chair. The brace panels resist bending of the support panel 34 and, in addition, provide additional support to the back panel.

Disassembly of the chair 10 is a simple matter. The end panel and brace panels may readily be manipulated to withdraw the brace panels from the slots 70 and the brace panels and end panel may be folded back into co-planar position relative to the support panel. The support panel is then folded about fold line 40 to bring it into engagement with the back panel 20. The seat panel 12 may readily be folded to bring it into face-to-face engagement with the back panel. The whole package then becomes quite compact and readily transported and stored.

As was the case with the chairs disclosed in U.S. Pat. No. 4,869,553 and the afore-mentioned U.S. Application Ser. No. 07/564,575, the reinforcement panel performs a significant function insofar as strength and stability of the present chair is concerned, regardless of the relative angle between the support panel and back panel when the chair is erected. Support panel 34 has a length L (FIG. 3) which is considerably less than the length it would have if the support panel were attached directly to the upper end 22 of back panel 20. This is because the reinforcement panel reduces the L/t ratio of support panel 34 ("t" being the thickness of paperboard material). This reduces flexure in support panel 34 and enables a material of less thickness than would otherwise be the case to be utilized to provide support for imposed axial loads on support panel 34.

Also, the reinforcement panel enables the span "1" of back panel 20 to be reduced. The bending moment is also therefore reduced. The back panel 20 acts as a beam and is subjected to bend when supporting superimposed load. The moment (in foot-pounds or inch-pounds) is determined by the formula $$M = \frac{wl^2}{8},$$

"w" equaling pounds per foot. Thus the moment is a function of the square of the span "1" (a geometric ratio). Bending moment determines section modulus as follows: S = M/f, where "f" equals fiber stress in bending. Therefore, reducing the span "1" reduces the required section modulus; hence material thickness required to resist the bending is reduced—all in geometric proportions.

Finally, the employment of reinforcement panel 32 reduces the "overturning moment" of the chair. That is, the chair is less likely to collapse when subjected to imposed load. All of the above, of course, have the cumulative effect of enabling the chair to be made of less thick sheet material then would otherwise be the case. Manufacturing costs are therefore reduced.

Figure 5:
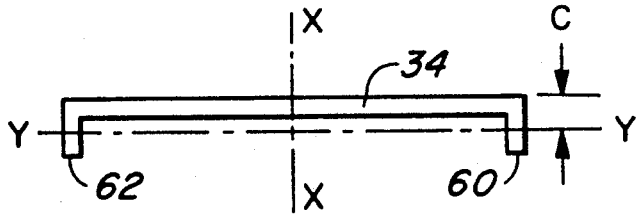
FIG. 5 is a diagrammatic presentation illustrating the cooperative structural relationship between the support panel and brace panels.
Figure 6:
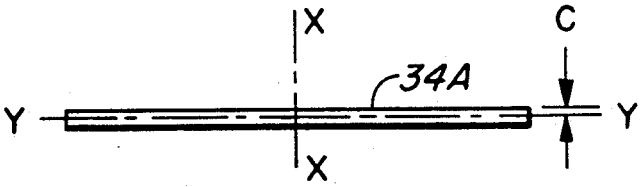
FIG. 6 is a diagrammatic presentation illustrating the structural characteristics of a support panel in the absence of brace panels.

The brace panels, as indicated above, further add to the strength and stability of the chair. This may be seen by comparing FIGS. 5 and 6. FIG. 5 is a cross-sectional diagrammatic presentation illustrating the cooperatric structural relationship between the support panel 34 and brace panels 60, 62. FIG. 6 is a cross-sectional diagrammatic presentation illustrating the structural characteristics of a support panel 34A in the absence of brace panels.

In FIG. 5, the brace panels and support panel create a "C" cross-section. The resulting "C" section has an increased moment of inertia I. Moment of inertia I may be defined as the sum of the products obtained by multiplying all of the elementary areas of a cross section by the squares of their distances from a given axis, usually the "neutral axis," which is the axis passing through the centroid of the section.

When comparing FIGS. 5 and 6 it is readily apparent that the brace panel/support panel combination shown in FIG. 5 has a greater moment of inertia about the Y—Y axis due to the increase in dimension c than does the support panel alone. This increase about the Y—Y axis is of relevance in this case in that the support panel is carrying imposed loads axially, i.e., in the direction of the flutes, and hence is acting as a column. The section modulus S is likewise increased, in that $S = I/c$.

Ability to resist axial or columnar loading is dependent upon allowable compressive stress of a given material, and the "slenderness ratio". This ratio is determined by dividing the overall unsupported length of a member by its radius of gyration r, r being calculated by the formula $r = \sqrt{I/A}$, A being the area of the section. It is apparent from this formula that an increased moment of inertia I will result in an increase in radius of gyration, and a decrease in slenderness ratio as indicated in the formula: slenderness ratio = 1/r (wherein 1 equals unsupported length). The smaller the slenderness ratio, the greater the strength of an element supporting columnar loads.

I claim:

1. A folding chair formed from sheet material, said chair comprising, in combination:

a seat panel having an outer surface and spaced first and second ends, said seat panel adapted to be positioned on the ground;

a back panel having an upper end and a lower end foldably connected at said lower end thereof to said seat panel second end, said back panel having an outer surface and being adapted to be positioned relative to said seat panel whereby said back panel extends upwardly from said seat panel and said back panel outer surface and said seat panel outer surface define an obtuse angle;

a support panel having an upper end and a lower end, said support panel upper end being located at said back panel and said support panel slanting downwardly and away from said back panel toward said ground;

an end panel adapted for positioning on the ground foldably connected to the support panel at the support panel lower end and projecting from said support panel when positioned on the ground; and at least one brace panel having an upper end and a lower end and connected to said support panel and extending between said back panel and said end panel to strengthen and stabilize said chair.

2. The folding chair according to claim 1 additionally comprising a reinforcement panel connected to said back panel, said reinforcement panel being in registry with a portion of said back panel located between said back panel upper and lower ends and in engagement therewith to reinforce said back panel portion, said support panel upper end being attached to said reinforcement panel and said at least one brace panel upper end engageable with said back panel immediately adjacent to said reinforcement panel.

3. The folding chair according to claim 1 wherein said at least one brace panel is folded relative to said support panel and extends inwardly toward said back panel.

4. The folding chair according to claim 3 additionally comprising means for maintaining said at least one brace panel folded relative to said support panel.

5. The folding chair according to claim 4 wherein said maintaining means comprises a slot defined by said end panel for receiving said at least one brace panel.

6. The folding chair according to claim 5 wherein said end panel is folded relative to said support panel and extends inwardly toward said back panel when said end panel slot receives said at least one brace panel.

7. The folding chair according to claim 6 wherein the lower end of said brace panel extends downwardly from said end panel when said end panel slot receives said at least one brace panel.

8. The folding chair according to claim 1 wherein a pair of brace panels are connected to said support panel and wherein said support panel has opposed side edges, said brace panels being spaced from one another and foldably connected to said support panel opposed side edges.

9. The folding chair according to claim 1 wherein the upper end of said at least one brace panel is tapered to define a tapered contact surface for contacting said back panel along substantially the full extent of said tapered contact surface.

10. The folding chair according to claim 1 wherein the lower end of said at least one brace panel is tapered to define a pointed ground engaging element.

11. The folding chair according to claim 1 constructed from corrugated paperboard sheet material.

* * * * *